US007019237B2

(12) United States Patent
Hong

(10) Patent No.: US 7,019,237 B2
(45) Date of Patent: Mar. 28, 2006

(54) SUPPORTING DEVICE FOR CONTROL BUTTONS OF ELECTRONIC INSTRUMENTS AND ELECTRONIC INSTRUMENTS ADAPTING THE SAME

(75) Inventor: Shin-hyeok Hong, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 11/156,664

(22) Filed: Jun. 21, 2005

(65) Prior Publication Data

US 2006/0016675 A1 Jan. 26, 2006

(30) Foreign Application Priority Data

Jul. 22, 2004 (KR) ..... 10-2004-0057111

(51) Int. Cl.
*H01H 9/00* (2006.01)

(52) U.S. Cl. ..... 200/296; 200/343; 200/331

(58) Field of Classification Search ..... 200/296, 200/5 A, 341–345, 330–332

See application file for complete search history.

(56) References Cited

U.S. PATENT DOCUMENTS

| | | | | |
|---|---|---|---|---|
| 5,003,133 | A * | 3/1991 | Kobayashi et al. | 200/343 |
| 6,051,799 | A * | 4/2000 | Fuhrmann | 200/331 |
| 6,492,605 | B1 * | 12/2002 | Iida | 200/343 |
| 6,570,111 | B1 * | 5/2003 | Nakagawa et al. | 200/343 |
| 6,633,011 | B1 * | 10/2003 | Ogawa et al. | 200/343 |
| 6,914,206 | B1 * | 7/2005 | Mukougawa | 200/341 |

FOREIGN PATENT DOCUMENTS

| | | |
|---|---|---|
| JP | 06-232570 | 8/1994 |
| JP | 09-167393 | 6/1997 |
| JP | 10-064138 | 3/1998 |
| KR | 1995-020945 | 7/1995 |
| KR | 2000-003756 | 2/2000 |

* cited by examiner

*Primary Examiner*—Michael A. Friedhofer
(74) *Attorney, Agent, or Firm*—Staas & Halsey LLP

(57) ABSTRACT

Disclosed is an electronic instrument including a body of the electronic instrument; a board installed in the body and having a tact switch operated by downward press force; a front panel attached at a front of the body; a control button fixed to a back face of the front panel at its one end so as to be resiliently deformed by a press force applied from a front direction thus to operate the tact switch; a supporting rib provided at the back face of the front panel to support an end of the control button; and a contact rib protruding from the back face of the front panel by a predetermined height so as to contact and support a certain position between the resiliently deformed portion and the fixed end of the control button.

20 Claims, 7 Drawing Sheets

SUPPORTING DEVICE FOR CONTROL BUTTONS OF ELECTRONIC INSTRUMENTS AND ELECTRONIC INSTRUMENTS ADAPTING THE SAME

CROSS-REFERENCE TO RELATED APPLICATIONS

This application claims benefit under 35 U.S.C. § 119 from Korean Patent Application No. 2004-57111, filed on Jul. 22, 2004, the entire content of which is incorporated herein by reference.

BACKGROUND OF THE INVENTION

1. Field of the Invention

The present invention relates to a supporting device for the control buttons of electronic instruments and electronic instruments adapting the same.

2. Description of the Related Art

Generally, electronic instruments such as DVD player, VCR, digital audio disk player, video disk player and the like include, at the front face of a front panel for access of recording media, a plurality of control buttons including one for selecting various functions, in accordance with their own functions.

Such control buttons are pushed rearward by a force applied from a front direction to control the contact with a tact switch installed to a main board so as to switch the mode of instruments or set a desired function.

Typically, the control buttons of the instruments are horizontally installed to a front panel from a back face thereof in such a manner that the respective knobs protrude in a frontal direction through the front panel. The tact switch is installed vertically on a board horizontally installed inside the instruments, so as to operatively touch its contact with the operation of the knob of the button. Thus, the control buttons are constructed so that a pressing force horizontally exerted to the knob is vertically transferred to the tact switch. To this end, the control button has a horizontal rectangular press portion at a lower portion of its back face, so that the press portion can be swung rearward with a horizontal force applied to closely contact with the tact switch.

Meanwhile, a control button has recently been proposed having its knob, press portion and the like formed on a single rib structure to facilitate the easy engagement with the front panel. Also, in course of the engagement with the front panel, a contact surface of the front panel and the control button would be in common so that the restricted inner space of the front panel could be effectively utilized.

FIGS. 1A and 1B are sectional views illustrating a control button installed to the front panel of a typical electronic instrument.

Referring the FIGS. 1A and 1B, a board 11 is horizontally placed in the body 10 of an electronic instrument. On the board 11, a tact switch 12 is installed which has a contact 12*a* that is operated with a vertical press force.

The front panel 20 is attached to the front of the body 10. The front panel 20 has an exposed outer panel 21 and a hidden inner panel 23 coupled thereto.

The control button 30 has a button rib 31 that is substantially parallel to the back face of the inner panel 23, a knob 33 extending forward from the button rib 31 that is exposed in front of the front panel 20, and a press portion 35 extending rearward from the button rib 31 to press the contact 12*a* of the tact switch 12.

The button rib 31 is fixedly put into a fixing boss 23*a* formed on the back face of the inner panel 23. Also, the button rib 31 has a deformable resilient portion 31*a* between a lower portion thereof supported by the fixing boss 23*a* and an upper portion thereof on which the knob 33 is provided. When the knob 33 is forced rearward in an arrow direction A, the upper portion of the button rib 31 is rearward and downward swung about the resilient portion 31*a* while the resilient portion 31*a* is resiliently deformed, so that the press portion 35 presses the contact 12*a*.

Meanwhile, in the above construction, in order that the knob 33 is not eccentrically positioned from the center of the through-hole 20*a* formed in the front panel 20, a protrusion 23*b* is formed on the back face of the inner panel 23. Since the upper portion of the button rib 31 is supported by being in contact with the protrusion 23*b*, the knob 33 is constantly positioned at the center of the through-hole 20*a*.

However, in such construction, the front panel 20 is fabricated as a mold product generally made of plastic materials in comparison with the body 10 of the instrument, so that it may be deformable when an external force is applied. Specifically, with recent demand for slim sized instruments, the thickness of the front panel 20 has become thinner. In this case, when the users contact the front panel 20 on the upper and lower portions, the front panel 20 is applied with a force in an arrow direction A illustrated in FIG. 1A, thus deforming the middle portion of the front panel 20. When the middle portion of the front panel 20 is deformed like this, a press force is produced so that the protrusion 23*b* moves the button rib 31 rearward. Accordingly, even though the users do not operate the knob 33, there is a problem in that the button rib 31 has a pressing force applied by the resilient deformation of the front panel 20, thus causing a malfunction of the tact switch 12.

SUMMARY OF THE INVENTION

Additional aspects and/or advantages of the invention will be set forth in part in the description which follows and, in part, will be apparent from the description, or may be learned by practice of the invention.

Accordingly, the present invention has been made to solve the above-mentioned problem occurring in the prior art, and an aspect of the present invention is to provide a supporting device for control buttons of electronic instruments and electronic instruments adapting the same so as to support the control buttons to prevent a malfunction of the same.

To accomplish this, in accordance with an aspect of the present invention, there is provided a supporting device for supporting control buttons of electronic instruments where the control button operates by vertically pressing a tact switch provided on a board installed in a body of the electronic instruments. The supporting device includes: a front panel attached to the body and having a through-hole; a control button including a button rib, a knob and a press portion, the button rib having an end fixed to the front panel, a substantially middle deformable resilient part and a swing part to be moved about the resilient part at the other end, the knob protruding forward out from the swing part through the through-hole, and the press portion protruding rearward from the swing part to selectively press the tact switch; a supporting rib having a predetermined height provided at a back face of the front panel so as to support the fixed end part of the button rib; and a contact rib having a predetermined height provided between the through-hole and the supporting rib at the back face of the front panel so as to contact and support the button rib.

The contact rib may be installed to contact and support the resilient part of the button rib.

The contact rib may be provided to have the same height as that of the supporting rib.

The supporting rib and the contact rib may be integrally formed on the front panel.

The supporting rib may have a plurality of protruded fixing hot-melt bosses, and the button rib has coupling holes coupled with the fixing hot-melt bosses at its one end.

The contact rib may be formed at a lower portion of the through-hole.

The front panel may include an outer panel exposed outside, and an inner panel attached to a back face of the outer panel and on which the supporting rib and the contact rib are integrally formed.

In accordance with another aspect of the present invention, there is provided an electronic instrument including a body of the electronic instrument; a board installed in the body and having a tact switch operated by downward press force; a front panel attached at a front of the body; a control button fixed to a back face of the front panel at its one end so as to be resiliently deformed by a press force applied from a front direction thus to operate the tact switch; a supporting rib provided at the back face of the front panel to support an end of the control button; and a contact rib protruding from the back face of the front panel by a predetermined height so as to contact and support a predetermined position between the resiliently deformed portion and the fixed end of the control button.

The control button may include a button rib, a knob and a press portion, wherein the button rib having a fixed part with a coupling hole coupled to the supporting rib, a deformable resilient part and a swing part to be swung about the resilient part when the resilient part is deformed, the knob forward protruding out from the swing part to receive a press force applied, and the press portion rearward protruding from the swing part to press the tact switch when the swing part is swung.

BRIEF DESCRIPTION OF THE DRAWINGS

The above aspects and features of the present invention will be more apparent by describing certain embodiments of the present invention with reference to the accompanying drawings, in which.

DETAILED DESCRIPTION OF THE PREFERRED EMBODIMENTS

Figure 1A:
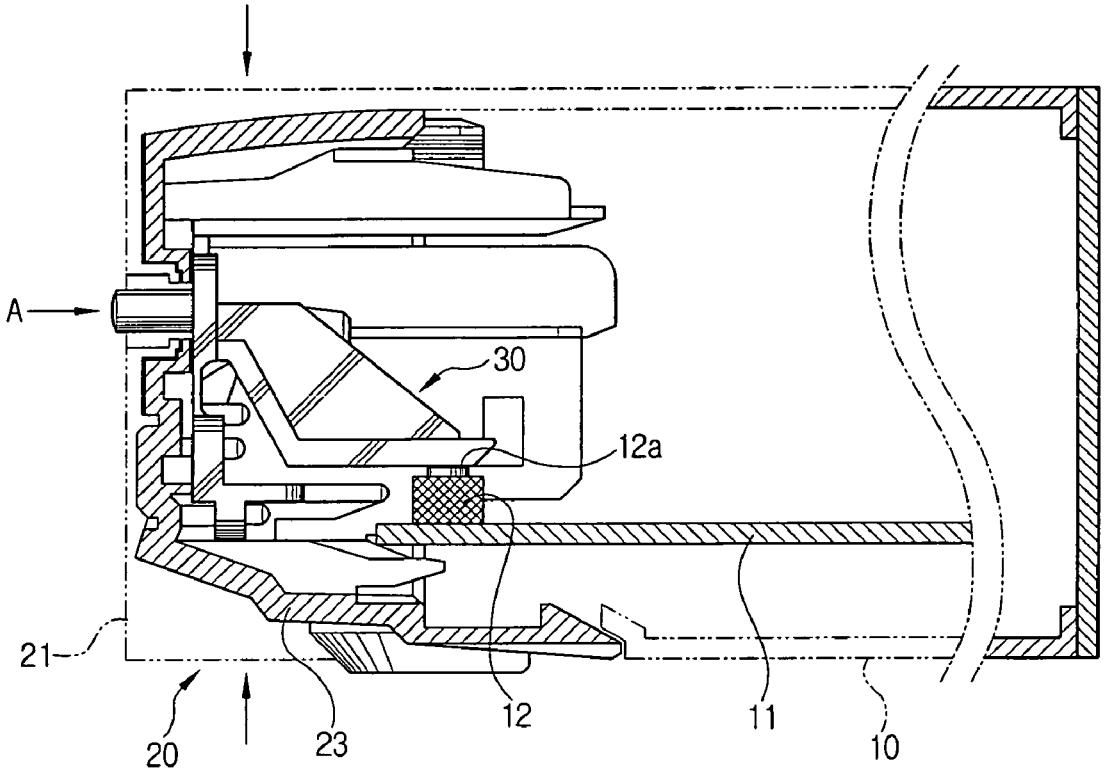
FIG. 1A (PRIOR ART)
FIG. 1A is a schematic sectional view of a conventional supporting device for control button.
Figure 1B:
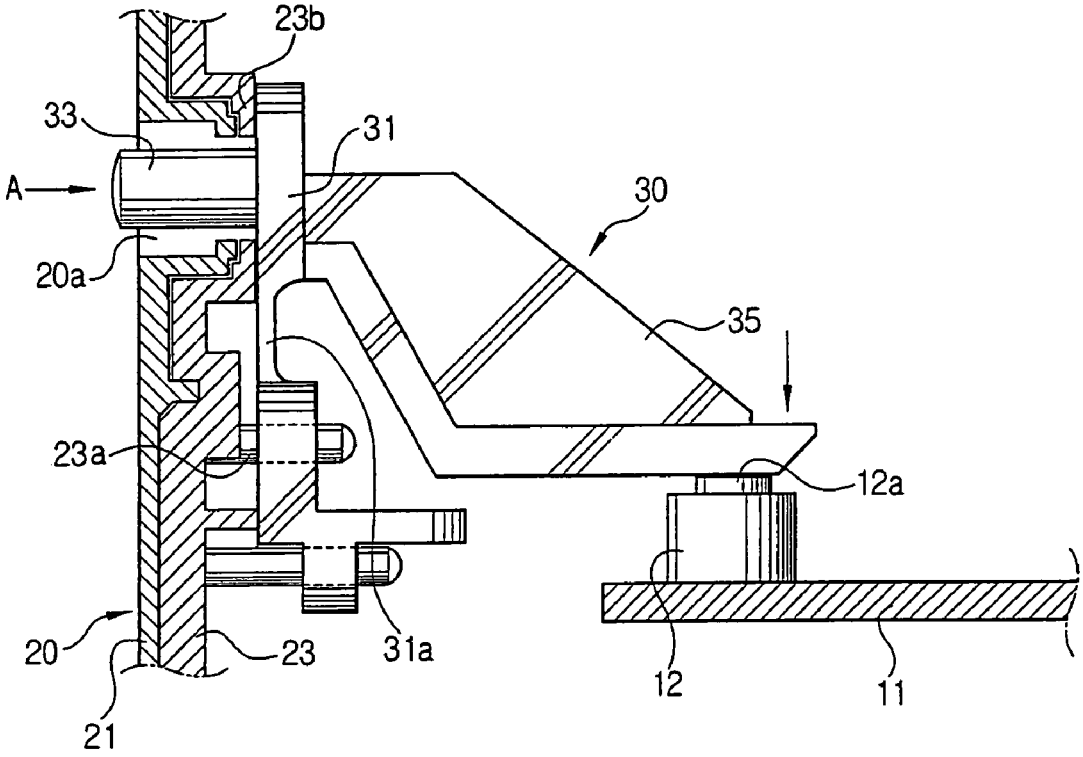
FIG. 1B (PRIOR ART)
FIG. 1B is a partial enlarged view illustrating essential parts of FIG. 1A.

Reference will now be made in detail to the embodiments of the present invention, examples of which are illustrated in the accompanying drawings, wherein like reference numerals refer to the like elements throughout. The embodiments are described below to explain the present invention by referring to the figures.

Figure 2:
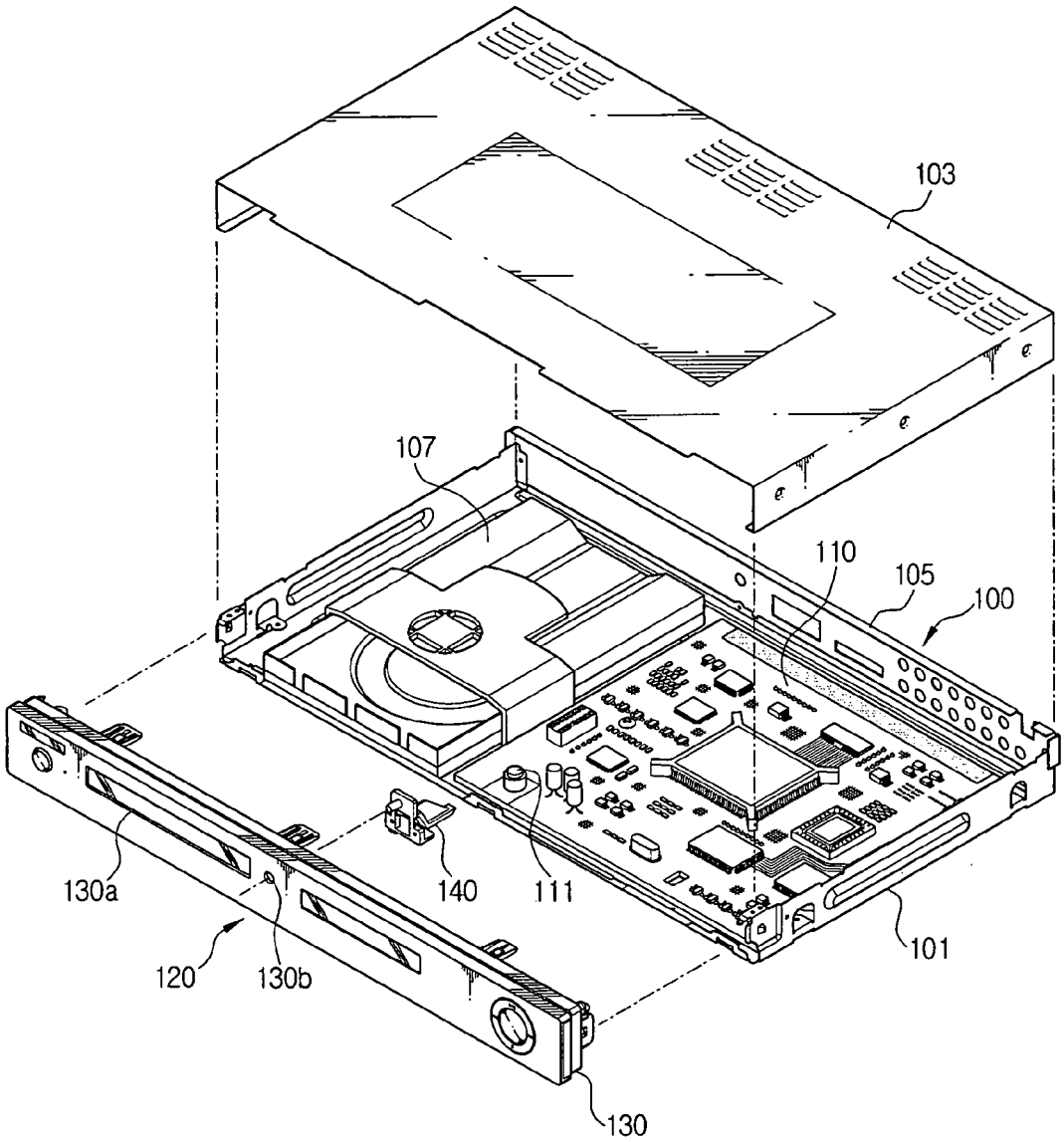
FIG. 2 is a schematic exploded perspective view of an electronic instrument according to an embodiment of the present invention.
Figure 3:
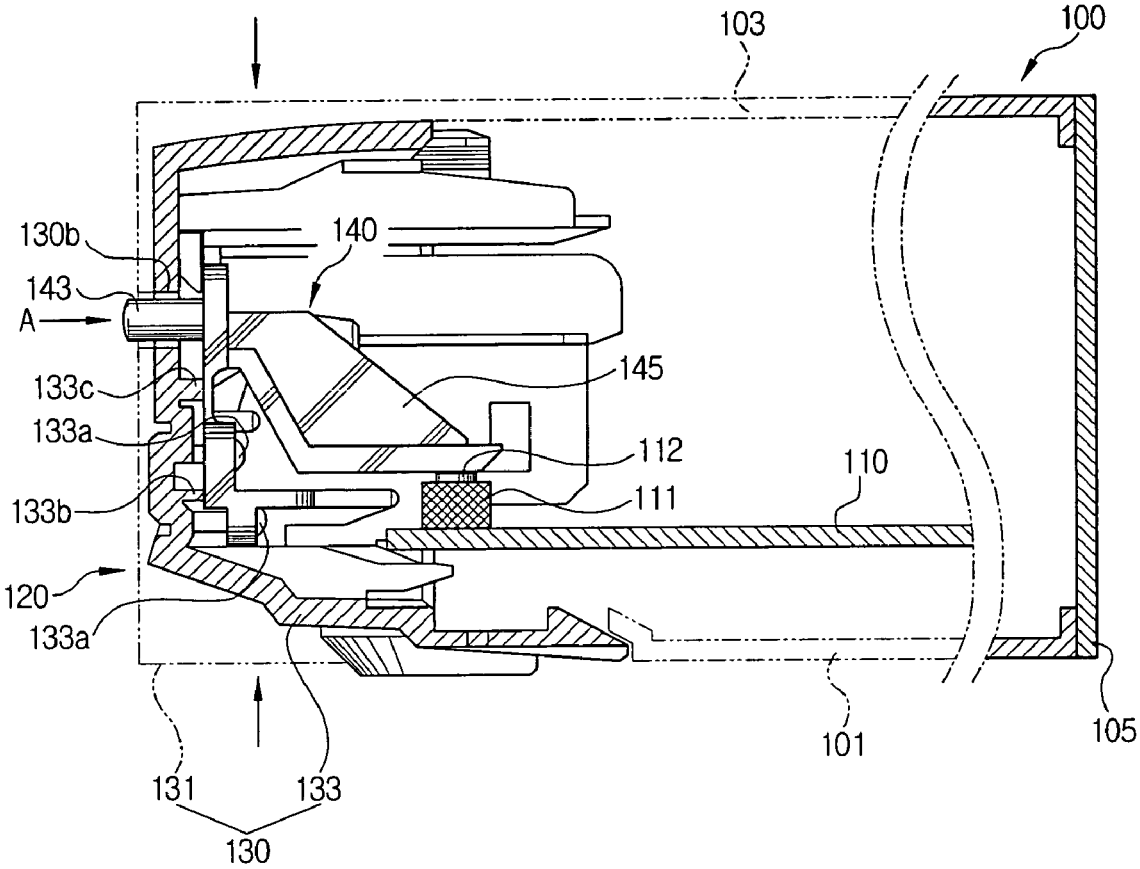
FIG. 3 is a sectional view of a supporting device for control button illustrated in FIG. 2.

Referring to FIGS. 2 and 3, a DVD player for recording/reproducing information to/from an optical disk will be illustrated as an electronic instrument according to an embodiment of the present invention. The electronic instrument includes a body 100 of the instrument, a board 110 installed in the body 100 and a supporting device 120 for a control button coupled to the front of the body 100.

The body 100 of the instrument is formed with a plurality of metal frames coupled together in box shape. The body 100 of the instrument includes a base frame 101, a cover frame 103 and a rear frame 105. A DVD deck 107 is installed on the base frame 101 as an example of recorder/player unit. The board 110 is installed on the base frame 101 to drive the DVD deck 107. A tact switch 111 is installed on the board 110 to control an operation of the instrument and to select a mode and a function of the instrument. The tact switch 111 has a contact 112 that is operated by being vertically pressed.

The supporting device 120 for control buttons includes a front panel 130 and a control button 140.

The front panel 130 has an outer panel 131 exposed in a front direction, and an inner hidden panel 133. The respective outer and inner panels 131 and 133 are molded products made of plastic materials.

The inner panel 133 is closely coupled to a back face of the outer panel 131. The front panel 130 also includes an access portion 130*a* through which recording media such as optical disks access.

The control button 140 operates the tact switch 111, and is coupled to the back face of the inner panel 133.

Figure 4A:
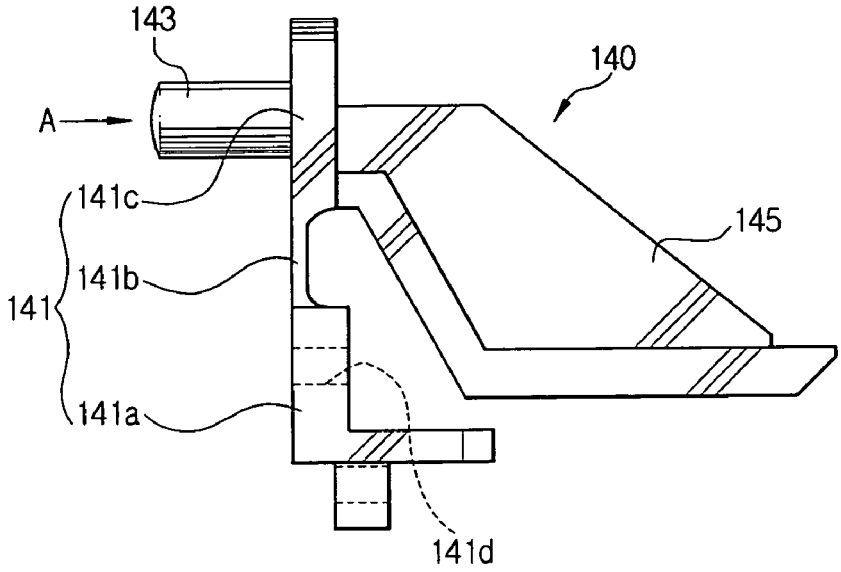
FIG. 4A is a side view of a control button illustrated in FIG. 3.
Figure 4B:
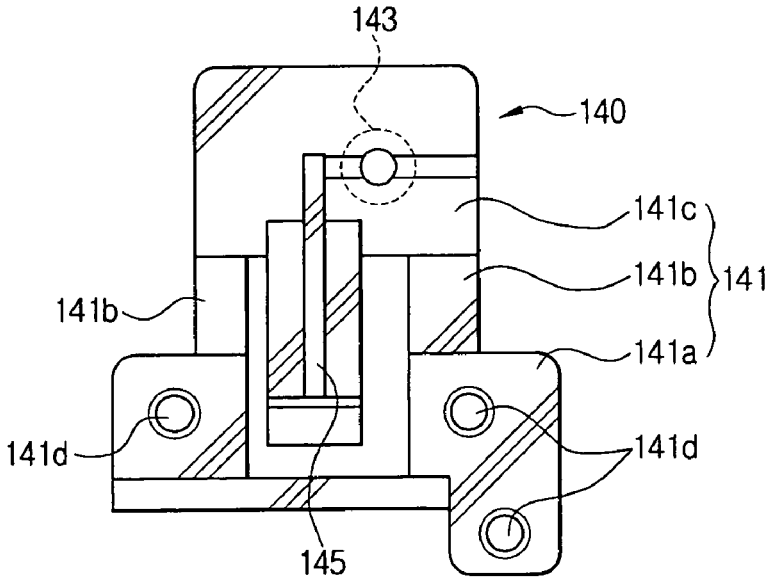
FIG. 4B is a front view of a control button illustrated in FIG. 3.

As shown in FIGS. 4A and 4B, the control button 140 includes a button rib 141 coupled to the back face of the inner panel 133, a knob 143 protruding forward from the button rib 141, and a press portion 145 extending from the button rib 141 opposite to the knob 143. The button rib 141 has a fixed part 141*a* at one end, a swing part 141*c* at the other end, and a deformable resilient part 141*b* at substantially the middle portion of the button rib 141.

The fixed part 141*a* corresponds to a lower portion of the button rib 141, and has a plurality of coupling holes 141*d* into which the fixing bosses 133*a* formed on the inner panel 133 are fixedly coupled by hot melting, for example. The resilient part 141*b* is provided between the fixed part 141*a* and the swing part 141*c* to have a thickness thinner than the surrounding portion therefrom.

The swing part 141*c* corresponds to the upper portion of the resilient part 141*b*. From the swing part 141*c*, the knob 143 protrudes forward and the press portion 145 extends rearward. When a press force is applied in an arrow direction A to the knob 143, the swing part 141*c* is swung rearward about the resilient part 141*b* as the resilient part 141*b* is resiliently deformed. Accordingly, the button rib 141 has a structure in which the upper portion thereof may be swung while the lower portion is fixed to the inner panel 133.

The knob 143 is integrally formed on the button rib 141 and protrudes forward through the through-hole 130*b* of the front panel 130. Herein, in comparison with the prior art, around the through-hole 130*b*, there is not provided a protrusion for contacting and supporting the swing part 141*c*.

The press portion 145 is formed to extend rearward from the swing part 141*c* so that it contacts and presses the contact 112 of the tact switch 111 when the swing part 141*c* is swung rearward about the resilient part 141*b*.

Figure 5A:
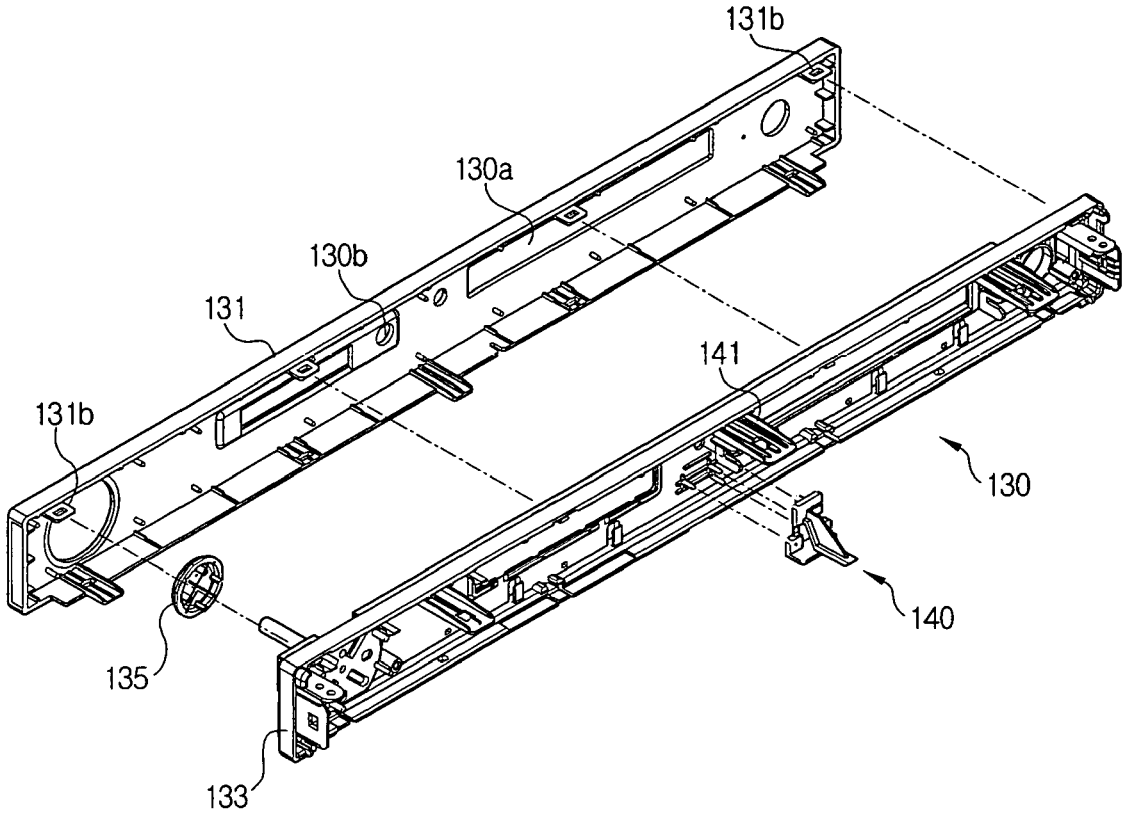
FIG. 5A is an exploded perspective of a front panel illustrated in FIG. 2.
Figure 5B:
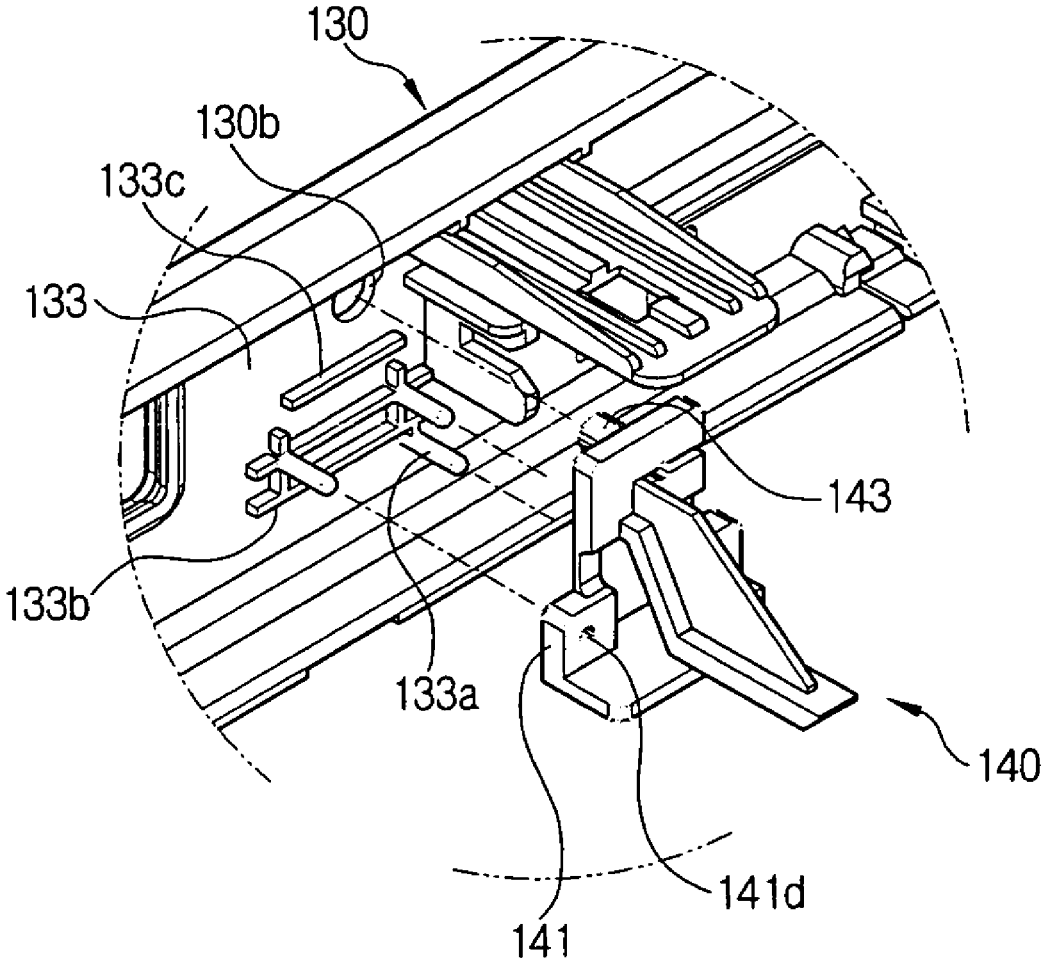
FIG. 5B is a partial perspective view illustrating essential parts of FIG. 5A.

Meanwhile, referring to FIGS. 5A and 5B, on the back face of the inner panel 133, the supporting rib 133*b* on which the fixing boss 133*a* is provided is formed in a certain shape. The supporting rib 133*b* is formed in a predetermined length from the back face of the inner panel 133. Therefore, when the button rib 141 is closely pushed toward the supporting rib 133*b* while the coupling holes 141*d* of the button rib 141 are coupled to the fixing bosses 133*a*, the button rib 141 positions the knob 143 substantially at the center of the through-hole 130*b*. When the button rib 141 is closely contacted with the supporting rib 133*b* to be parallel to the back face of the inner panel 133, a fixing process such as hot melting of the fixing boss 133*a* can be conducted easily.

Also, on the back face of the inner panel 133, the contact rib 133*c* is formed to contact and support the button rib 141 so as to maintain a certain distance between the back face of the inner panel 133 and the button rib 141.

Preferably, the contact rib 133*c* contacts and supports the portion lower from the swing center of the button rib 141, i.e., the deformable resilient part 141*b*. In this embodiment, the contact rib 133*c* is positioned between the supporting rib 133*b* and the through-hole 130*b* so as to contact and support the resilient part 141*b*. Also, the contact rib 133*c* is formed in a predetermined length extending rearward from the inner panel 133, thus simultaneously contacting and supporting the pair of resilient parts 141*b* formed on the button rib 141.

As such, the fixed part 141*a* of the button rib 141 of the control button 140 is fixed to the inner panel 133. Also, the contact rib 133*c* contacts and supports the resilient part 141*b* serving as a swing center of the control button 140. Accordingly, the button rib 141 can be stably fixed to the back face of the inner panel 133 so as to stably position the knob 143 at a center of the through-hole 130*b*. Also, when the knob 143 is pressed rearward, the resilient part 141*b* is deformed so that the swing part 141*c* of the button rib 141 is swung to allow the press part 145 to press the contact 112 of the tact switch 111, thereby operating the tact switch 111.

Meanwhile, a reference numeral 135 of FIG. 5A indicates a functional key installed between the front panel 131 and the inner panel 133. Also, a reference numeral 131*b* indicates a locking portion formed at the front panel 131 and locked to a certain portion of the inner panel 133.

Further, hereinafter, a case will be explained in which, as shown in FIG. 3, a press force is applied in the arrow directions to the supporting device of the present invention respectively from an upper/lower portion thereof.

In this case, the front panel 130 may be resiliently deformed by a press force applied from the upper or lower directions. The contact rib 133*c* formed integrally on the inner panel 133 may also be applied with a press force from the front/rear directions. A rearward press force may be transferred from the contact rib 133*c* to the resilient part 141*b*. However, the control button 140 according to this embodiment can be swung about the resilient part 141*b* only when a press force is applied to the upper portion of the resilient part 141*b*, i.e., the swing part 141*c*. Also, even through a press force is applied to the resilient part 141*b* by the contact rib 133*c*, the resilient part 141*b* cannot be resiliently deformed to the extent that the swing part 141*c* is swung. That is, a press force by the contact rib 133*c* is absorbed at the resilient part 141*b* so as not to affect a swing movement of the swing part 141*c*.

Of course, since the upper portion of the button rib 141 from the resilient part 141*b*, i.e., the swing part 141*c*, is spaced apart by a certain distance from the inner panel 133, there cannot be a case where the inner panel 133 is deformed to directly contact and press the resilient part 141*c*.

As described before, in accordance with a supporting device for control buttons of electronic instruments and the electronic instruments adapting the same of the present invention, a portion lower from the resilient part, a swing center of the control button, is supported by the contact rib to prevent a press force by the deformation of the inner panel from being transferred to the swing part of the control button.

Accordingly, although the front panel is deformed by an external force, a malfunction that the control button is swung to operate the tact switch is prevented, increasing stability and reliability of an electronic instrument.

The foregoing embodiment and advantages are merely exemplary and are not to be construed as limiting the present invention. The present teaching can be readily applied to other types of apparatuses. Also, the description of the embodiments of the present invention is intended to be illustrative, and not to limit the scope of the claims, and many alternatives, modifications, and variations will be apparent to those skilled in the art.

What is claimed is:

1. A supporting device for supporting control buttons of electronic instruments, the control button operatively vertically pressing a tact switch provided on a board installed in a body of the electronic instruments, the supporting device comprising:

a front panel attached to the body and having a through-hole;

a control button including a button rib, a knob and a press portion, the button rib having an end fixed to the front panel a deformable resilient part disposed at a substantially middle portion and a swing part at the other end to be moved about the resilient part, the knob forward protruding out from the swing part through the through-hole, and the press portion rearward protruding from the swing part to selectively press the tact switch;

a supporting rib having a predetermined height provided at a back face of the front panel so as to support the fixed end part of the button rib; and a contact rib having a predetermined height provided between the through-hole and the supporting rib at the back face of the front panel so as to contact and support the button rib.

2. The supporting device as claimed in claim 1, wherein the contact rib is installed to contact and support the resilient part of the button rib.

3. The supporting device as claimed in claim 1, wherein the contact rib is provided to have the same height as that of the supporting rib.

4. The supporting device as claimed in claim 1, wherein the supporting rib and the contact rib are integrally formed on the front panel.

5. The supporting device as claimed in claim 1, wherein the supporting rib has a plurality of protruded fixing hot-melt bosses, and the button rib has coupling holes coupled with the fixing hot-melt bosses at the fixed end.

6. The supporting device as claimed in claim 1, wherein the contact rib is formed at a lower portion of the through-hole.

7. The supporting device as claimed in claim 1, wherein the front panel comprises an outer panel exposed to the outside, and an inner panel attached to a back face of the outer panel and on which the supporting rib and the contact rib are integrally formed.

8. An electronic instrument, comprising:

a body of the electronic instrument;

a board installed in the body and having a tact switch operated by downward press force;

a front panel attached at a front of the body;

a control button fixed to a back face of the front panel at its one end so as to be resiliently deformed by a press force applied from a front direction thus to operate the tact switch;

a supporting rib provided at the back face of the front panel to support an end of the control button; and a contact rib protruding from the back face of the front panel by a predetermined height so as to contact and support a certain position between a resiliently deformed portion and the fixed end of the control button.

9. The electronic instrument as claimed in claim 8, wherein the control button comprises:

a button rib having a fixed part with a coupling hole coupled to the supporting rib, a deformable resilient part and a swing part to be swung about the resilient part when the resilient part is deformed;

a knob forward protruding out from the swing part to receive a press force applied; and a press portion protruding rearward from the swing part to press the tact switch when the swing part is swung.

10. The electronic instrument as claimed in claim 9, wherein the front panel has a through-hole into which the knob is inserted, the through-hole being positioned higher than the supporting rib, and the contact rib is provided between the through-hole and the supporting rib.

11. The electronic instrument as claimed in claim 9, wherein the contact rib is installed to contact and support the resilient part.

12. The electronic instrument as claimed in claim 8, wherein the contact rib and the supporting rib are provided integrally on the front panel to have the same length.

13. The electronic instrument as claimed in claim 8, wherein the front panel comprises an outer panel exposed outside, and an inner panel attached to a back face of the outer panel and on which the supporting rib and the contact rib are integrally formed.

14. A method for supporting control buttons of electronic instruments, the control button operatively vertically pressing a tact switch provided on a board installed in a body of the electronic instruments, the method comprising:

attaching a front panel to the body, the front panel having a through-hole;

providing a control button including a button rib, a knob and a press portion, the button rib having an end fixed to the front panel a deformable resilient part disposed at a substantially middle portion and a swing part at the other end to be moved about the resilient part, the knob protruding forward from the swing part through the through-hole, and the press portion protruding rearward from the swing part to selectively press the tact switch;

attaching a supporting rib having a predetermined height to a back face of the front panel so as to support the fixed end part of the button rib; and installing a contact rib having a predetermined height between the through-hole and the supporting rib at the back face of the front panel so as to contact and support the button rib.

15. The method of claim 14, wherein the contact rib is installed to contact and support the resilient part of the button rib.

16. The method of claim 14, wherein the contact rib has the same height as the supporting rib.

17. The method of claim 14, wherein the supporting rib and the contact rib are integrally formed on the front panel.

18. The method of claim 14, wherein the supporting rib has a plurality of protruded fixing hot-melt bosses, and the button rib has coupling holes coupled with the fixing hot-melt bosses at its one end.

19. The method of claim 14, wherein the contact rib is formed at a lower portion of the through-hole.

20. The method of claim 14, wherein the front panel comprises an outer panel exposed to the outside, and an inner panel attached to a back face of the outer panel and on which the supporting rib and the contact rib are integrally formed.

* * * * *

UNITED STATES PATENT AND TRADEMARK OFFICE

CERTIFICATE OF CORRECTION

PATENT NO. : 7,019,237 B2
APPLICATION NO. : 11/156664
DATED : March 28, 2006
INVENTOR(S) : Shin-hyeok Hong It is certified that error appears in the above-identified patent and that said Letters Patent is hereby corrected as shown below:

Column 7, line 12: Delete “its” before “one end”.

Signed and Sealed this

Twelfth Day of September, 2006

JON W. DUDAS
*Director of the United States Patent and Trademark Office*